US010442203B2

(12) United States Patent
Nakakubo et al.

(10) Patent No.: US 10,442,203 B2
(45) Date of Patent: Oct. 15, 2019

(54) LIQUID EJECTION HEAD, AND LIQUID EJECTION APPARATUS

(71) Applicant: CANON KABUSHIKI KAISHA, Tokyo (JP)

(72) Inventors: Toru Nakakubo, Kawasaki (JP); Satoshi Kimura, Kawasaki (JP); Shingo Okushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/028,846

(22) Filed: Jul. 6, 2018

(65) Prior Publication Data

US 2019/0016137 A1 Jan. 17, 2019

(30) Foreign Application Priority Data

Jul. 12, 2017 (JP) ..... 2017-136574

(51) Int. Cl.
*B41J 2/165* (2006.01)

(52) U.S. Cl.
CPC ..... *B41J 2/16505* (2013.01); *B41J 2/16508* (2013.01); *B41J 2/16585* (2013.01); *B41J 2002/16502* (2013.01)

(58) Field of Classification Search
CPC . B41J 2/16505; B41J 2/16508; B41J 2/16585
See application file for complete search history.

(56) References Cited

U.S. PATENT DOCUMENTS

| | | | | |
|---|---|---|---|---|
| 9,962,937 | B2 | 5/2018 | Okushima et al. | |
| 10,022,979 | B2 | 7/2018 | Okushima et al. | |
| 10,040,290 | B2 | 8/2018 | Okushima et al. | |
| 2017/0197409 | A1* | 7/2017 | Okushima ..... | B41J 2/145 |
| 2017/0232737 | A1 | 8/2017 | Komamiya et al. | |
| 2017/0274647 | A1 | 9/2017 | Aoki et al. | |
| 2017/0313076 | A1 | 11/2017 | Okushima et al. | |
| 2017/0326875 | A1 | 11/2017 | Nakakubo et al. | |
| 2017/0341398 | A1 | 11/2017 | Tamenaga et al. | |

FOREIGN PATENT DOCUMENTS

WO 2012/023939 A1 2/2012

* cited by examiner

*Primary Examiner* — Bradley W Thies
(74) *Attorney, Agent, or Firm* — Venable LLP

(57) ABSTRACT

A liquid ejection head and a liquid ejection apparatus capable of maintaining high reliability include a first cover member including an aperture and covering a surface of a flow path member facing a print medium of the liquid ejection head, a second cover member covering a side surface of the liquid ejection head, and a displacement absorption part that absorbs the displacement between the first cover member and the second cover member. Furthermore, the space between the aperture and the flow path member is sealed with a sealing material.

17 Claims, 17 Drawing Sheets

LIQUID EJECTION HEAD, AND LIQUID EJECTION APPARATUS

BACKGROUND OF THE INVENTION

Field of the Invention

The present invention relates to a liquid ejection head and a liquid ejection apparatus configured to eject liquid.

Description of the Related Art

In a liquid ejection head configured to eject liquid from an ejection port, a cap used in a recovery process for maintaining a good ejection state of the liquid is required to be airtight when abutting the liquid ejection head. However, it is necessary, in the case of an elongated head, to cause the cap to abut across a plurality of print element boards, and therefore it is difficult to raise the airtightness of the cap. In such case, a face cover is provided and the face cover is caused to abut the cap on a surface facing the print medium and belonging to an ejection module configured to eject liquid and a liquid ejection unit including a flow path member that allows liquid to flow into the ejection module, within the liquid ejection head. Accordingly, it is possible to keep the flatness of the abutting part and raise the airtightness.

In International Laid-Open No. WO2012/023939, a face cover with a bent periphery is provided at a position facing the print medium of the print head. In International Laid-Open No. WO2012/023939, although occurrence of missing dots between print element boards is prevented by arranging the print element boards in a zigzag manner, the method displaces the print element boards with a partial overlapping, resulting in wider and larger heads. Accordingly, there is proposed an in-line arrangement method that arranges print element boards with a smaller amount of displacement, as a method of arranging print element boards with a higher density. The in-line arrangement method arranges print element boards with a small amount of displacement, thereby allowing for a narrower width of heads.

Here, in the case where the aperture ratio of the aforementioned face cover, i.e. the ratio of aperture for exposing the print element board from the face cover is large, there has been a risk that the stiffness of the face cover may decrease. Particularly, the width of the heads according to the in-line arrangement method is narrow in comparison with the case where the print element boards are arranged in a zigzag manner, there has been a risk that the aperture ratio of the face cover may be higher, reducing the stiffness thereby. In contrast, bending the end of the face cover as described in International Laid-Open No. WO2012/023939 is effective for raising the stiffness of the face cover.

However, raising the stiffness of the face cover too high by bending, which may result in warpage or the like of the face cover, makes it difficult to provide the face cover in a manner conforming with the entire head region when joining it with a liquid ejection unit including an ejection module and a flow path member. In addition, adhering causes stress on a joint part between the face cover and the liquid ejection unit, which may result in peeling while in use.

SUMMARY OF THE INVENTION

Accordingly, the present invention provides a liquid ejection head and a liquid ejection apparatus capable of maintaining a high reliability.

To achieve those, a liquid ejection head of the present invention includes: a liquid ejection unit having a board including an ejection port surface configured to eject liquid, and a flow path member including a supporting surface that supports the board on the back side of the ejection port surface, the flow path member being configured to supply liquid to the board; a first cover member including a first surface provided at the side of the ejection port surface and having an aperture part exposing the ejection port surface and a joint part joined between the aperture part and the liquid ejection unit, a second surface covering a part of the side surface of the flow path member, and a bent part bent between the first surface and the second surface; and a second cover member at least covering a part which is different from the aforementioned part, a part of the second surface of the first cover member and a part of the second cover member overlapping with each other.

According to the present invention, it is possible to realize liquid ejection head and a liquid ejection apparatus capable of maintaining a high reliability.

Further features of the present invention will become apparent from the following description of exemplary embodiments with reference to the attached drawings.

DESCRIPTION OF THE EMBODIMENTS

First Embodiment

Figure 1:
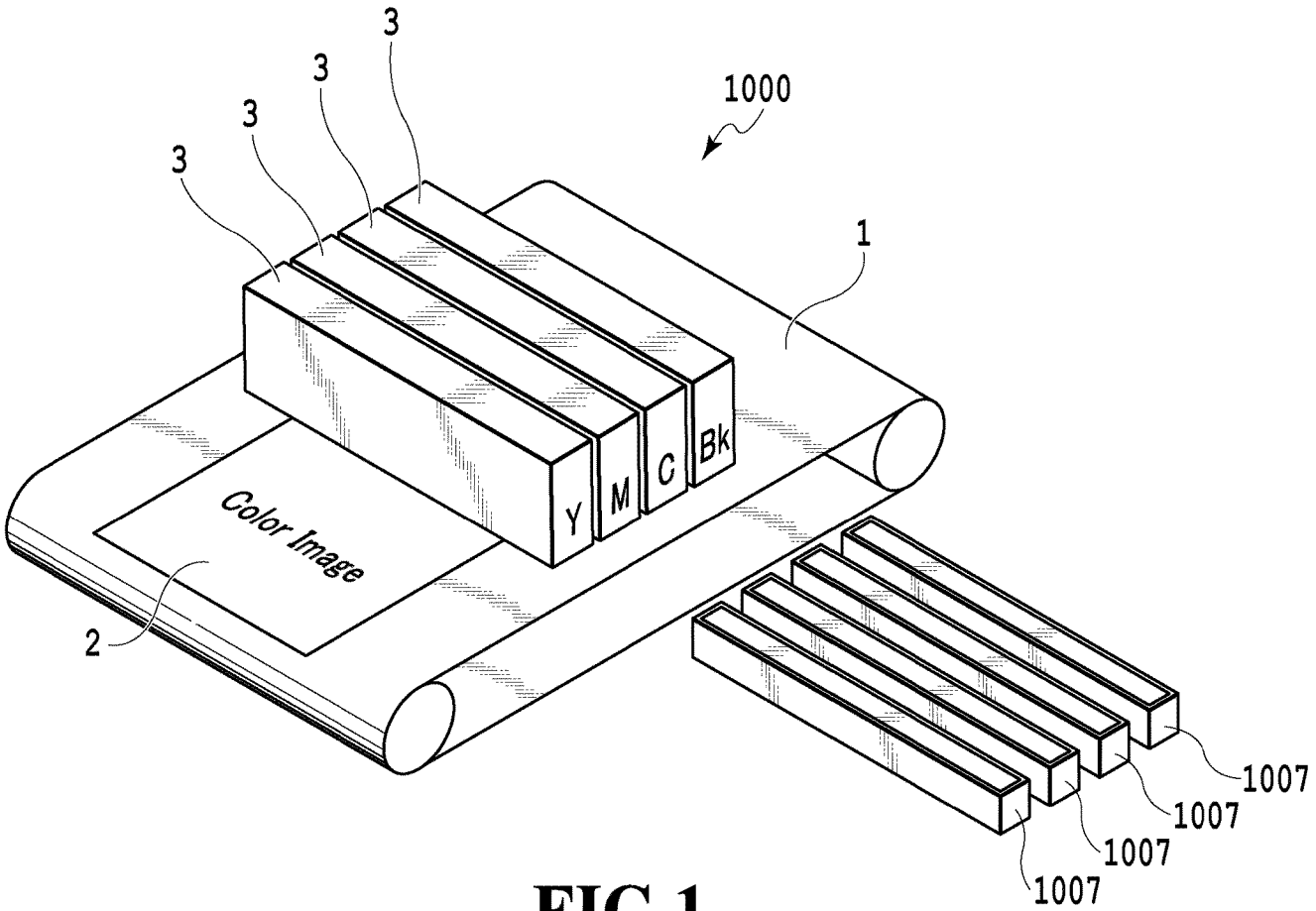
FIG. 1 is a perspective view illustrating a major part of a liquid ejection apparatus.

In the following, a first embodiment of the present invention will be described, referring to the drawings. However, the following description is not intended to limit the scope of the present invention. Although a thermal method that generates air foam by a heating element to eject liquid is employed in the present embodiment as an example, the present invention may also be applied to a liquid ejection head employing a piezoelectric method and a variety of other liquid ejection methods. In addition, although the first embodiment is a liquid ejection apparatus in the form of circulating liquid such as ink between a tank and liquid ejection heads, it may take other forms.

FIG. 1 is a perspective view illustrating a major part of a liquid ejection apparatus of the present embodiment. A liquid ejection apparatus 1000 performs full color printing on a print medium 2 conveyed by a conveyance unit 1 by providing in parallel four liquid ejection heads 3 corresponding to respective ink colors of cyan C, magenta M, yellow Y and black K and ejecting ink in accordance with print data. The liquid ejection heads 3 has a plurality of ejection ports that eject liquid arranged in a plurality of columns, the number of columns of ejection ports available per color being 20.

Accordingly, significantly high-speed printing becomes possible by distributing print data across a plurality of ejection port column as appropriate to perform printing. Furthermore, the liquid ejection apparatus 1000 is preferable for commercial printing or the like in that it allows for suppressing degradation of print quality even in the presence of an ejection port that fails to eject, by causing ejection ports of another column located at a position corresponding to the print medium conveyance direction relative to the failed ejection port to perform ejection in a substitutional manner, thereby improving the reliability.

Each liquid ejection head 3 has a supply system of the liquid ejection apparatus 1000, a buffer tank 1003, and a main tank 1006 connected thereto in fluid communication. In addition, each liquid ejection head 3 has electrically connected thereto an electric control unit configured to transmit electric power and ejection control signals to the liquid ejection head 3.

(Description of Circulation Path)

Figure 2:
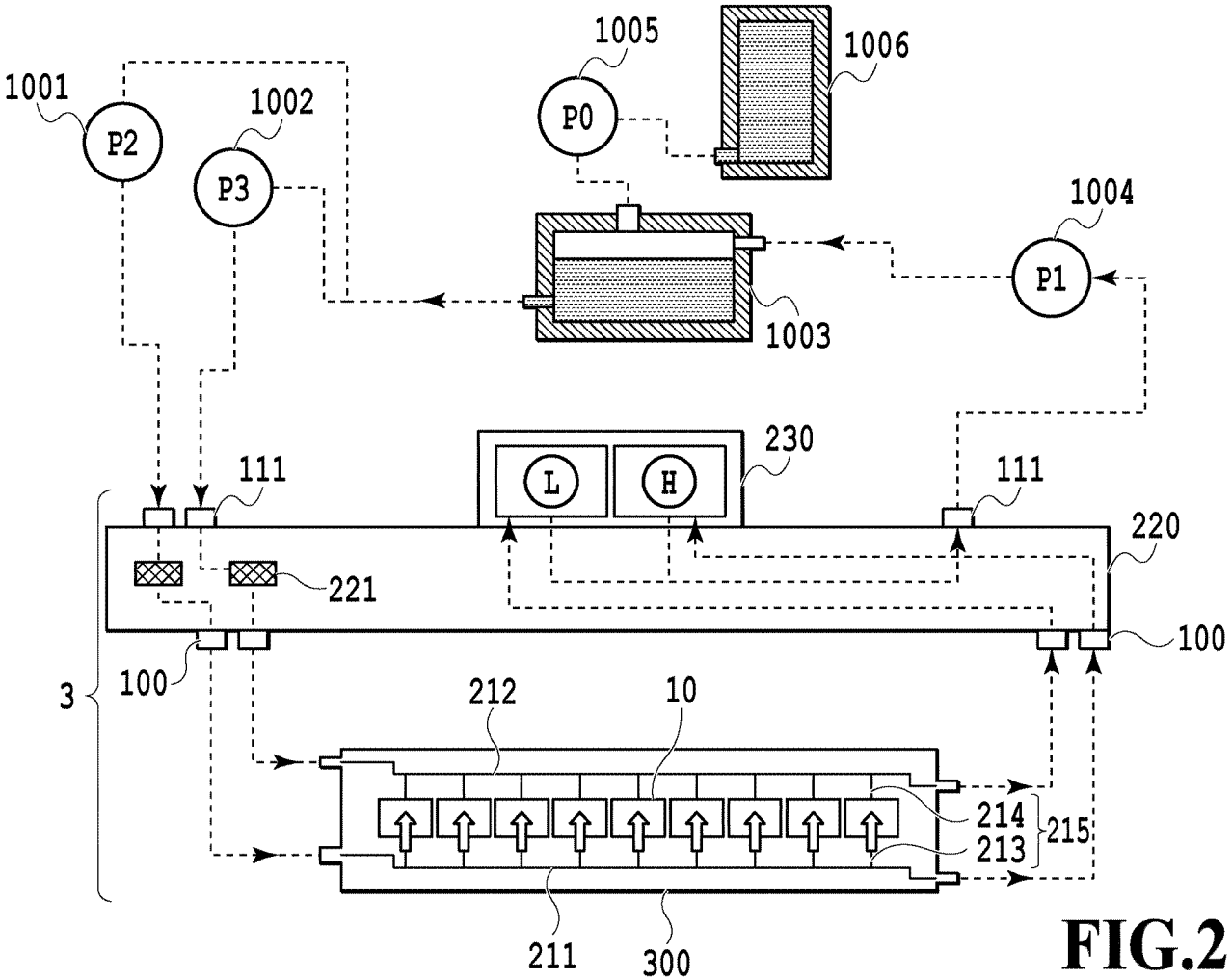
FIG. 2 is a schematic view illustrating a circulation path applied to the liquid ejection apparatus.

FIG. 2 is a schematic view illustrating a circulation path applied to the liquid ejection apparatus of the present embodiment. The liquid ejection head 3 is connected in fluid communication to a first recirculation pump (high-pressure side) 1001, the first recirculation pump (low-pressure side) 1002, a buffer tank 1003, or the like. Note that although only a path allowing the flow of ink of one color out of cyan C, magenta M, yellow Y and black K is illustrated in FIG. 2 for simplicity of description, there are, in practice, circulation paths for four colors provided in the liquid ejection head 3 and the printing apparatus main body.

Ink in the main tank 1006 is supplied to the buffer tank 1003 by a refill pump 1005. The ink is subsequently branched into two flow paths and circulates in two flow paths, namely, the high-pressure side and the low-pressure side, by an action of a negative-pressure control unit 230 provided in the liquid ejection head 3. The ink branched into the two flow paths, namely, the high-pressure side and the low-pressure side, is supplied to the liquid ejection head 3 via liquid connecting parts 111 by an action of the first recirculation pump (high-pressure side) 1001 and the first recirculation pump (low-pressure side) 1002. Subsequently, the ink circulated in the liquid ejection head by an action of the first recirculation pump (high-pressure side) 1001 and the first recirculation pump (low-pressure side) 1002 passes through the negative-pressure control unit 230 and is discharged from the liquid ejection head 3 via the liquid connecting parts 111. The discharged ink is returned to the buffer tank 1003 by the second recirculation pump 1004.

Both of the two pressure force adjustment mechanisms included in the negative-pressure control unit 230 are mechanisms (mechanism components that exhibit the same effect as the so-called "back pressure regulator") that controls the pressure at the upstream side of the negative-pressure control unit 230 to vary within a constant range around a desired setting pressure. The second recirculation pump 1004 acts as a negative pressure source that depressurizes the downstream side of the negative-pressure control unit 230. In addition, the first recirculation pump (high-pressure side) 1001 and the first recirculation pump (low-pressure side) 1002 are provided at the upstream side of the liquid ejection head, whereas the negative-pressure control unit 230 is provided at the downstream side of the liquid ejection head.

The negative-pressure control unit 230 stabilizes the pressure variation at the upstream side of the negative-pressure control unit 230 (i.e. the side of the liquid ejection unit 300) within a constant range around a preliminarily set pressure, even in the presence of variation of the flow amount due to the deviation of the amount of ejection per unit area. In the circulation flow path of the present embodiment, the downstream side of the negative-pressure control unit 230 is pressurized by the second recirculation pump 1004 via a liquid supply unit 220. In this manner, it is possible to suppress the effect of water head pressure of the buffer tank 1003 on the liquid ejection head 3, thereby allowing for a wider selection of the layout of the buffer tank 1003 in the printing apparatus 1000. The foregoing is also applicable to, for example, a waterside tank provided, in place of the second recirculation pump 1004, to the negative-pressure control unit 230 with a predetermined water head difference.

The negative pressure control unit 230 has two negative pressure control mechanisms each having different control pressures set therein. Of the two negative pressure control mechanisms, the side set to a high pressure (denoted as H in FIG. 2) and the side set to a low pressure (denoted as L in FIG. 2) are respectively connected to a common supply flow path 211 or a common collection flow path 212 in the liquid ejection unit 300 via the liquid supply unit 220. Setting the pressure of the common supply flow path 211 relatively higher than the pressure of the common collection flow path 212 by the two negative pressure control mechanisms causes a flow of liquid from the common supply flow path 211 to the common collection flow path 212 via an individual flow path 215 and an internal flow path of each print element board 10.

(Description of Liquid Ejection Head Configuration)

Figure 3A:
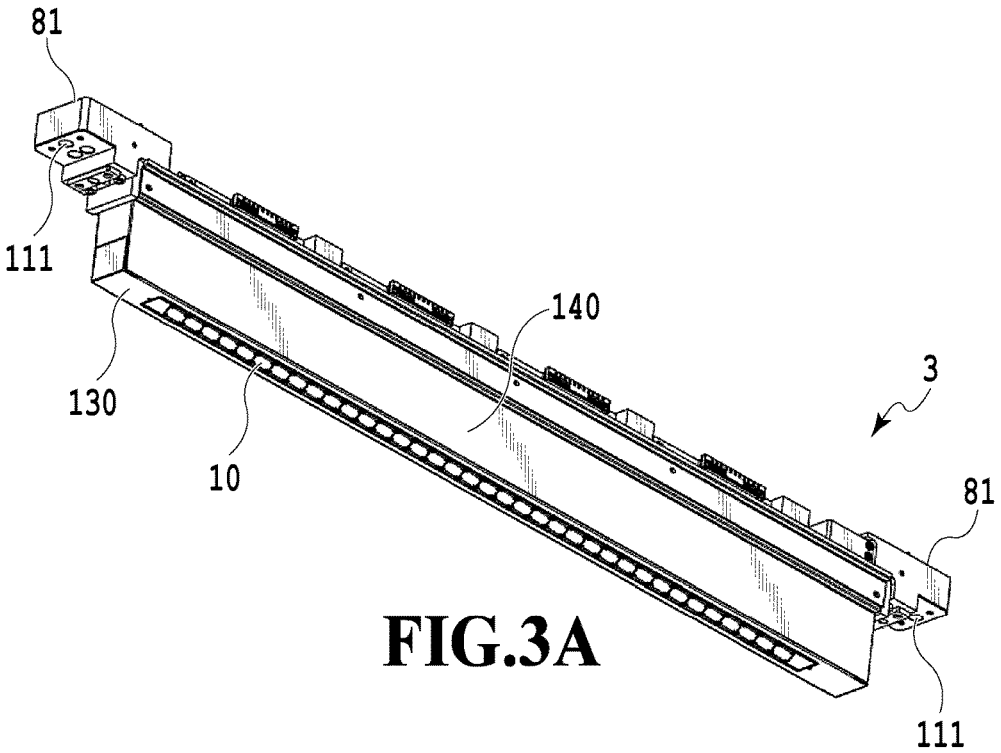
FIG. 3A is a perspective view illustrating an ejection head.
Figure 3B:
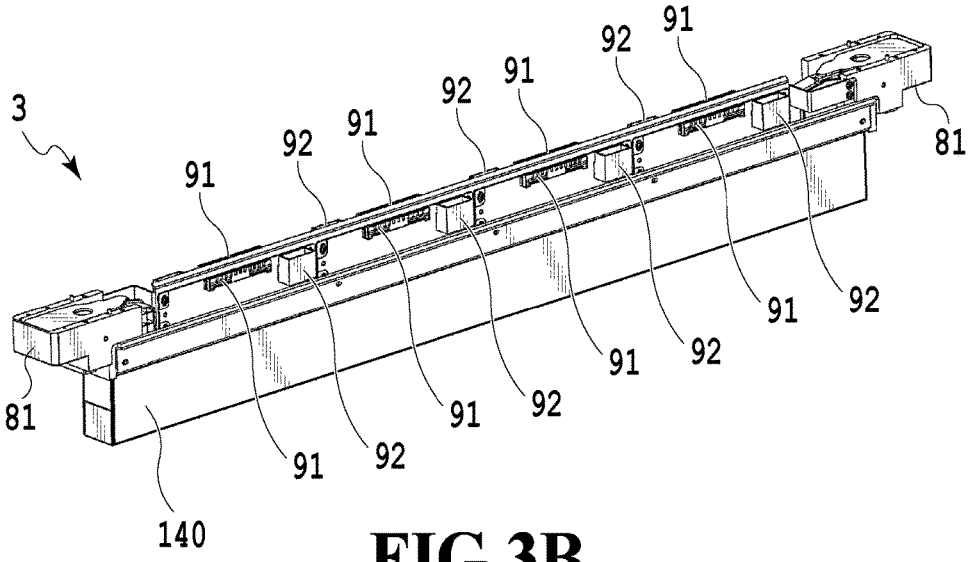
FIG. 3B is a perspective view illustrating the ejection head.

A configuration of the liquid ejection head 3 according to the present embodiment will be described. FIGS. 3A and 3B are the perspective views illustrating the liquid ejection head 3 according to the present embodiment. The liquid ejection head 3, including 16 print element boards 10 linearly arranged in the longitudinal direction, is a line-type inkjet print head capable of printing with single-color liquid. The liquid ejection head 3 includes the liquid connecting parts 111, signal input terminals 91, and power source terminals 92. The liquid ejection head 3 has the signal input terminals 91 and the power source terminals 92 provided on both sides of the liquid ejection head 3. The purpose is to reduce voltage drop and signal transmission delay that may occur in the wiring unit provided in the print element board 10. As illustrated in FIG. 3A, the liquid connecting parts 111 provided on both ends of the liquid ejection head 3 are connected to the liquid supply system of the printing apparatus 1000. Accordingly, it turns out that the ink is supplied from the supply system of the liquid ejection apparatus 1000 to the liquid ejection head 3 and the ink which has passed through the liquid ejection head 3 is collected into the supply system of the printing apparatus 1000. As has been described above, the ink of each color is allowed to circulate via the path of the printing apparatus 1000 and the path of the liquid ejection head 3.

Figure 4:
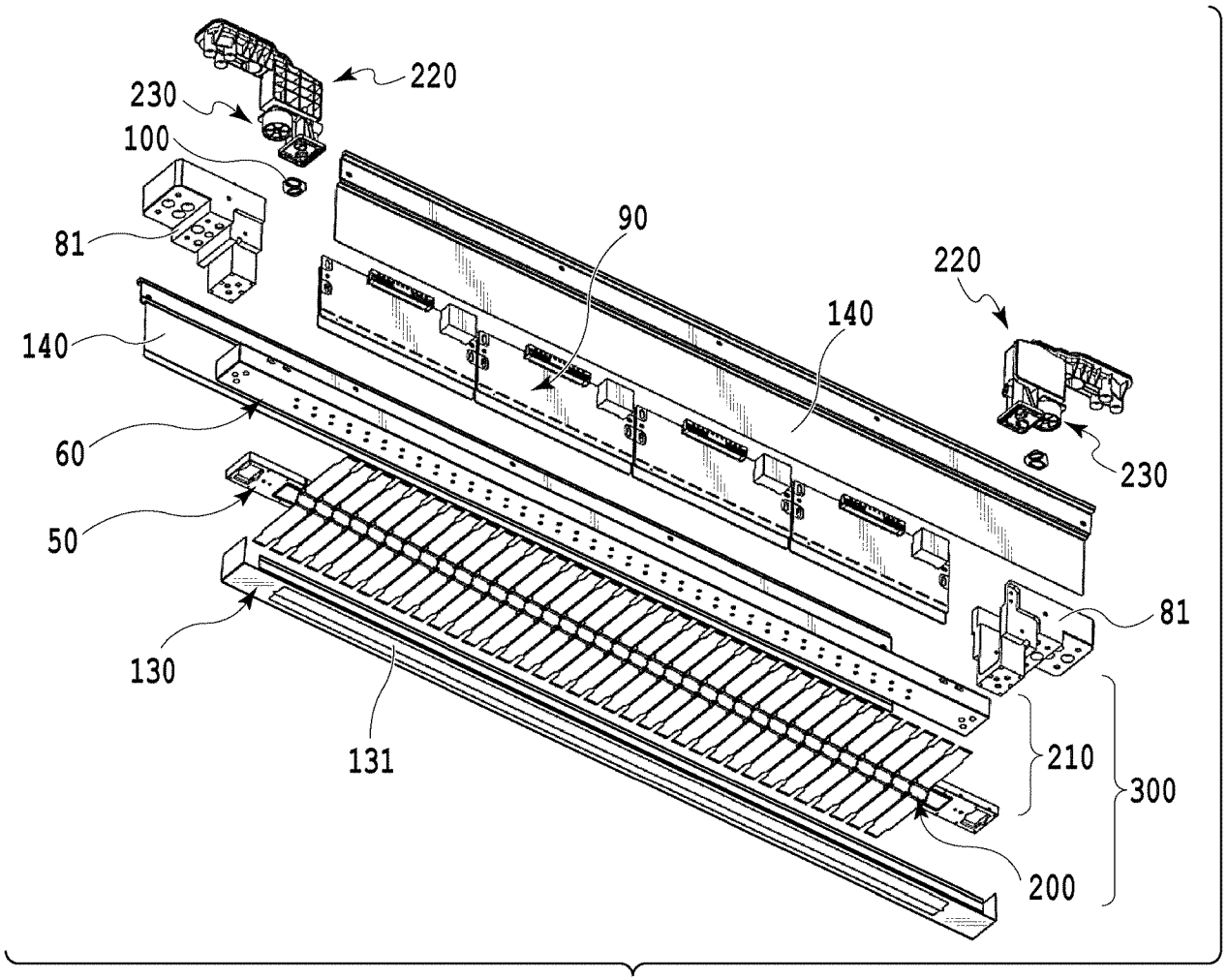
FIG. 4 is an exploded perspective view illustrating respective components or units included in the liquid ejection head.

FIG. 4 is an exploded perspective view illustrating respective components or units included in the liquid ejection head 3. Stiffness of the liquid ejection head 3 is ensured by the second flow path member 60 included in the liquid ejection unit 300. A liquid ejection unit supporting part 81 in the present embodiment is connected to both ends of the second flow path member 60, and the liquid ejection unit 300 is mechanically coupled to a carriage of the liquid ejection apparatus 1000 and performs positioning of the liquid ejection head 3. The liquid supply unit 220 including the negative-pressure control unit 230 and an electric wiring board 90 are coupled to the liquid ejection unit supporting part 81. The liquid supply unit 220 has the liquid connecting parts 111 (see FIG. 3A) provided thereon, and also has filters 221 for respective colors provided inside thereof (see FIG. 2) in communication with respective apertures of the liquid connecting parts 111 to remove foreign matter in the supplied ink.

The two negative-pressure control units 230 are configured to control pressure using respectively different, relativity high and low, negative pressures. In addition, providing the negative-pressure control units 230 at the high-pressure side and the low-pressure side on both ends of the liquid ejection head 3 as illustrated in the drawing results in mutually facing liquid flows in the common supply flow path 211 and the common collection flow path 212 extending in the longitudinal direction of the liquid ejection head 3. Such a setting is advantageous in that heat exchange is facilitated between the common supply flow path 211 and the common collection flow path 212, which results in an unlikeliness of temperature difference among a plurality of the print element boards 10 provided along the common flow path, whereby uneven printing due to temperature difference is suppressed.

Next, details of a flow path member 210 of the liquid ejection unit 300 will be described. As illustrated in FIG. 4, the flow path member 210, being formed by laminating the first flow path member 50 and the second flow path member 60, distributes the liquid supplied from the liquid supply unit 220 to respective ejection modules 200. In addition, the flow path member 210 functions as a flow path member so as to return the recirculating liquid from the ejection modules 200 to the liquid supply unit 220. Not only being a flow path member having the common supply flow path 211 and the common collection flow path 212 formed inside thereof, the second flow path member 60 of the flow path member 210 also has a function of mainly ensuring the stiffness of the liquid ejection head 3. Accordingly, the material of the second flow path member 60 is preferred to have a sufficient corrosion resistance against liquid and a high mechanical strength. Specifically, metal materials such as SUS, Ti, aluminum, or ceramic such as alumina are preferred.

The liquid ejection unit supporting part 81 has an aperture provided thereon through which joint rubber 100 is inserted. The liquid supplied from the liquid supply unit 220 is guided to the liquid ejection unit 300 via the joint rubber. The liquid ejection unit 300, including a plurality of ejection modules 200 and the flow path member 210, has the first cover member 130 attached on the surface of the liquid ejection unit 300 at the print medium side. Here, the first cover member 130 is a member having a picture-frame like surface with an elongated aperture 131 provided thereon, the print element board 10 and the sealing material included in the ejection modules 200 being exposed from the aperture 131. The frame part surrounding the aperture 131 has a function as an abutting surface of the cap member that caps the liquid ejection head 3 while waiting for printing. Accordingly, a closed space is formed during the capping by coating an adhesive material, sealing material, filling material or the like around the aperture 131 and smoothing the unevenness and filling the gap on the surface of the ejection port of the liquid ejection unit 300.

Figure 5:
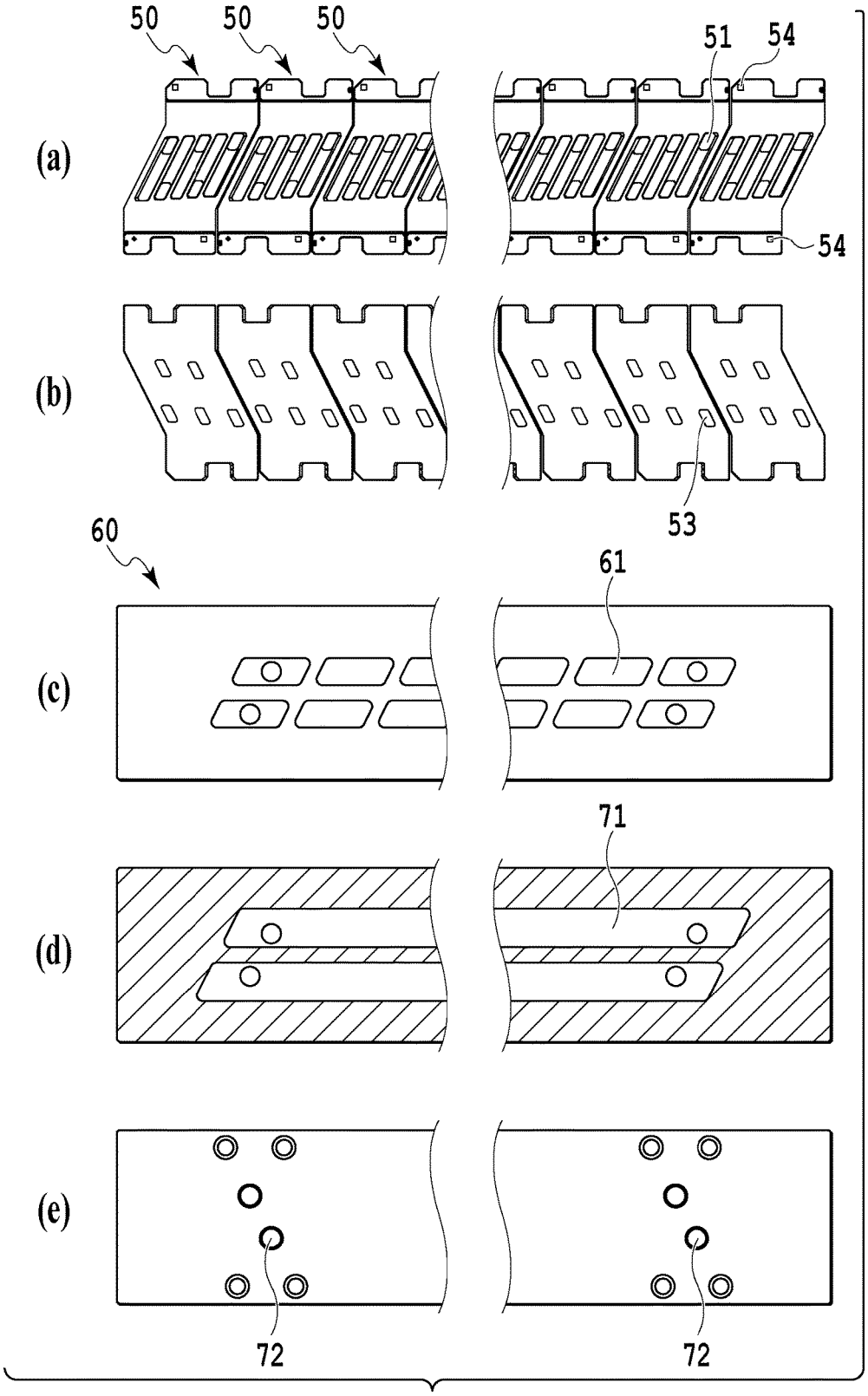
FIG. 5 illustrates a first flow path member.

FIG. 5 illustrates a first flow path member. Part (a) of FIG. 5 illustrates the surface (supporting surface) of the first flow path member 50 on which the ejection modules 200 are mounted, and part (b) of FIG. 5 illustrates its back side, i.e., the surface that abuts the second flow path member 60. The first flow path member 50 of the present embodiment has adjacently arranged therein a plurality of members corresponding to each of the ejection modules 200. Employing a structure divided as described above allows for arranging a plurality of modules in accordance with the length of the liquid ejection head 3, and therefore the structure is applicable particularly to the relatively long-scale liquid ejection head in accordance with, for example, the B2 size or longer. As illustrated in part (a) of FIG. 5, communication ports 51 of the first flow path member 50 are in fluid communication with the ejection modules 200 and, as illustrated in part (b) of FIG. 5, individual communication ports 53 of the first flow path member 50 are in fluid communication with the communication ports 61 of the second flow path member 60. Part (c) of FIG. 5 illustrates the surface of the second flow path member 60 that abuts the first flow path member 50, part (d) of FIG. 5 illustrates the cross-section of the central part of the second flow path member 60 in the thickness direction, and part (e) of FIG. 5 illustrates the surface of the second flow path member 60 that abuts the liquid supply unit 220. One of common flow path grooves 71 of the second flow path member 60 is the common supply flow path 211 illustrated in FIG. 6 described below, and the other is the common collection flow path 212, each of which is provided in the longitudinal direction of the liquid ejection head 3, with liquid being supplied from one end to the other end thereof. In the present embodiment, the flows of liquid in the common supply flow path 211 and the common collection flow path 212 are opposite to each other.

Figure 6:
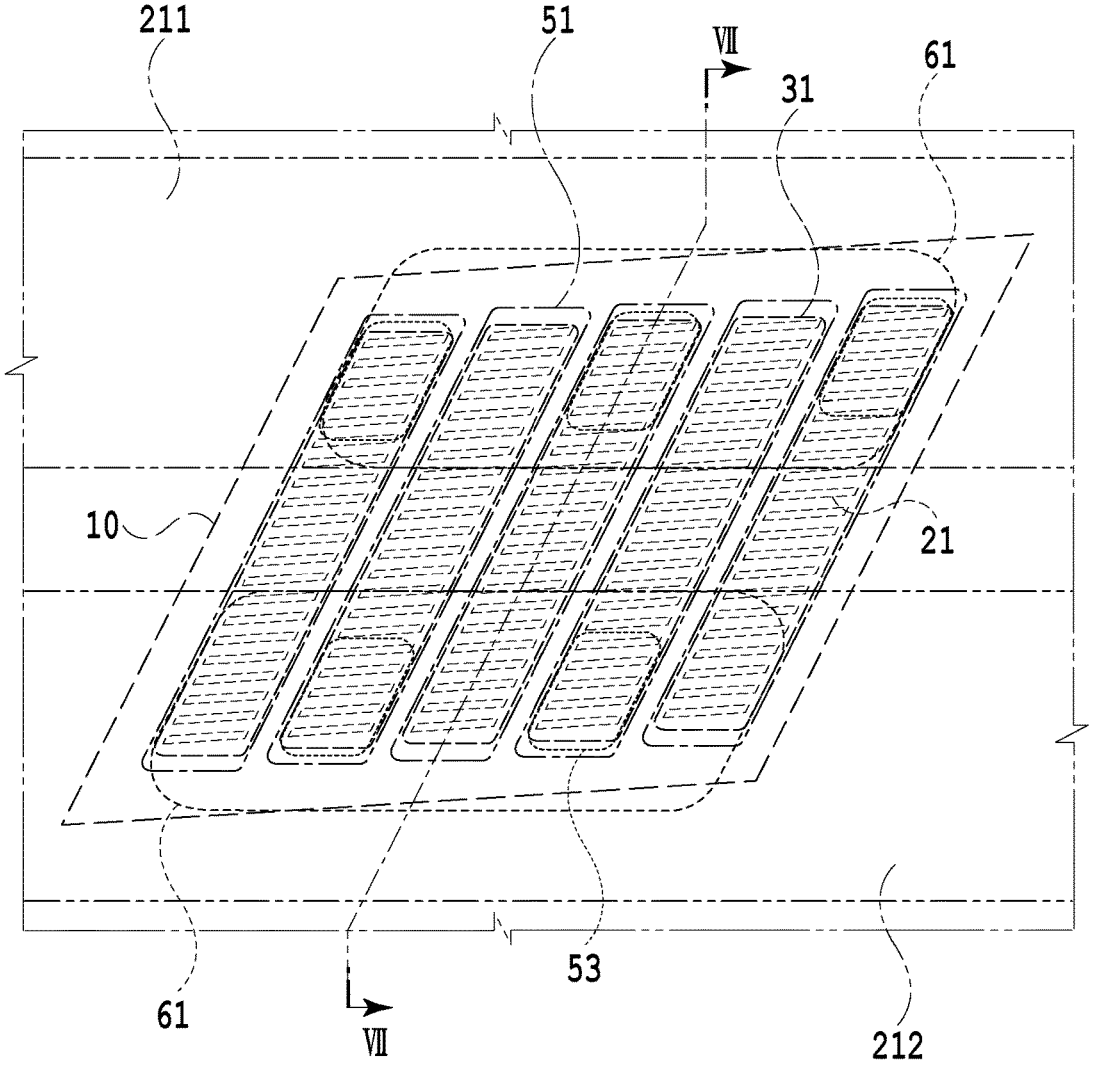
FIG. 6 is a perspective view illustrating a connection relation between a print element board and a liquid flow path member.

FIG. 6 is a perspective view illustrating a connection relation of the print element board 10 and the flow path member 210 with liquid. The flow path member 210 has provided therein a pair of the common supply flow path 211 and the common collection flow path 212 extending in the longitudinal direction of the liquid ejection head 3. The communication ports 61 of the second flow path member 60 are connected to the individual communication ports 53 of the first flow path member 50 in a positioned manner, whereby a liquid supply flow path providing liquid communication is formed from the common supply flow path 211 of the second flow path member 60 to the communication ports 51 of the first flow path member 50 via the communication ports 61. Similarly, a liquid supply path providing liquid communication is formed from the communication ports 61 of the second flow path member 60 to the communication ports 51 of the first flow path member 50 via the common collection flow path 212.

Figure 7:
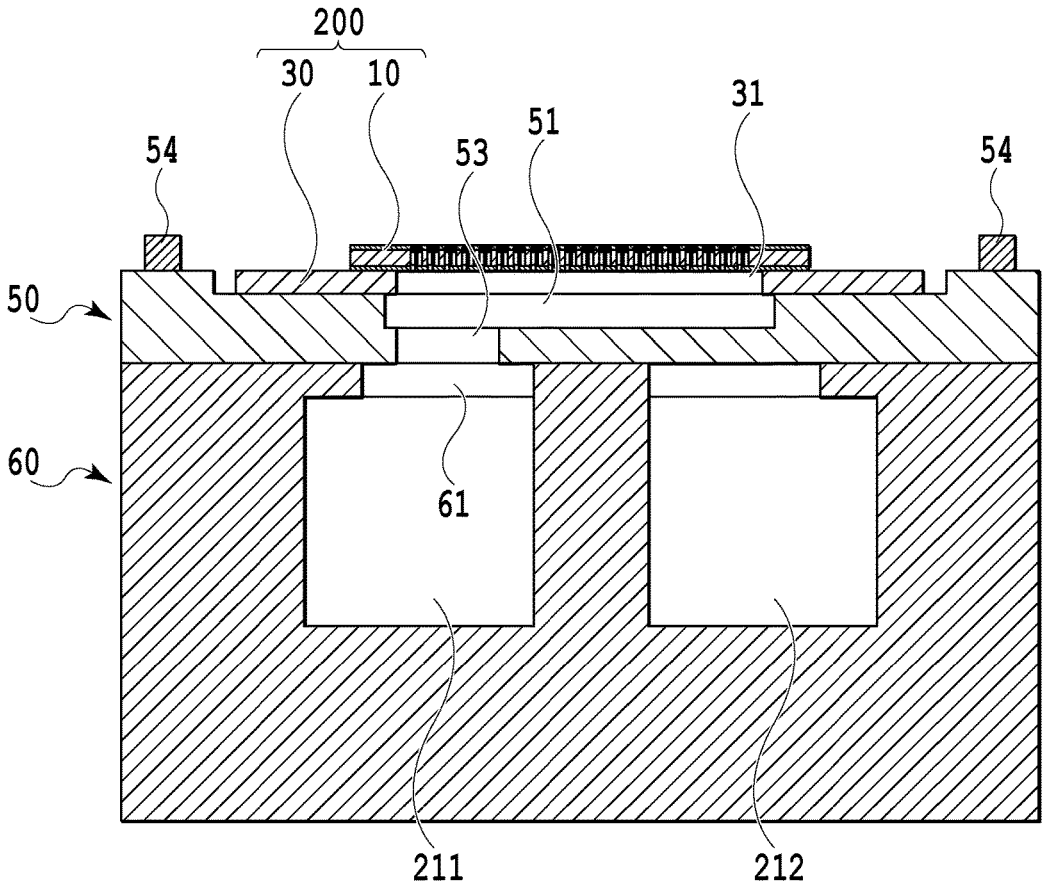
FIG. 7 illustrates a cross-section along section line VII-VII of FIG. 6.

FIG. 7 illustrates a cross-section taken along section line VII-VII of FIG. 6. The common supply flow path 211 is connected to the ejection module 200 via the communication ports 61, the individual communication ports 53, and the communication ports 51. Although not illustrated in FIG. 7, it is apparent that the common collection flow path 212 is connected to ejection module 200 via a similar path in another cross-section, referring to FIG. 6. Each of the ejection modules 200 and the print element boards 10 has formed thereon a flow path in communication with each ejection port, so that a part or all of the supplied liquid is allowed to recirculate through the ejection port which has stopped the ejection operation. In addition, the common supply flow path 211 is connected to the negative-pressure control unit 230 (high-pressure side) and the common collection flow path 212 is connected to the negative-pressure control unit 230 (low-pressure side), via the liquid supply unit 220. Therefore, the pressure difference generates flow that flows from the common supply flow path 211 to the common collection flow path 212 through the pressure chamber of the print element board 10.

(Description of Ejection Module)

Figure 8A:
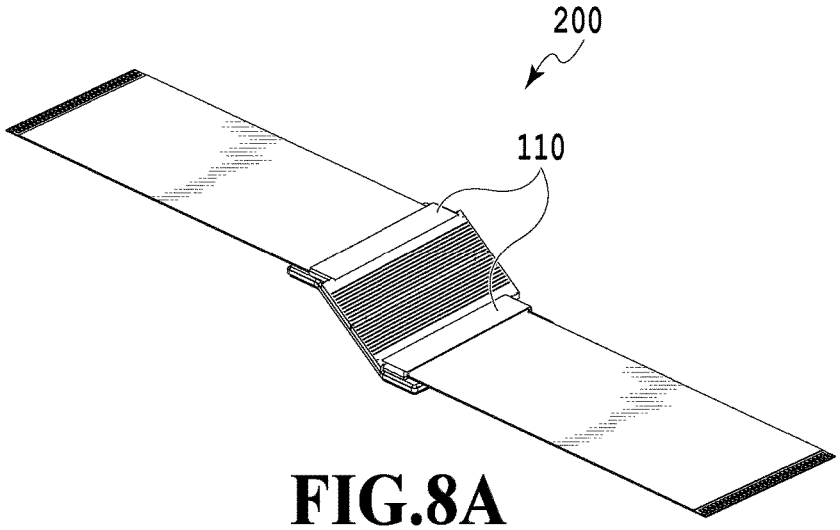
FIG. 8A is a perspective view of an ejection module.
Figure 8B:
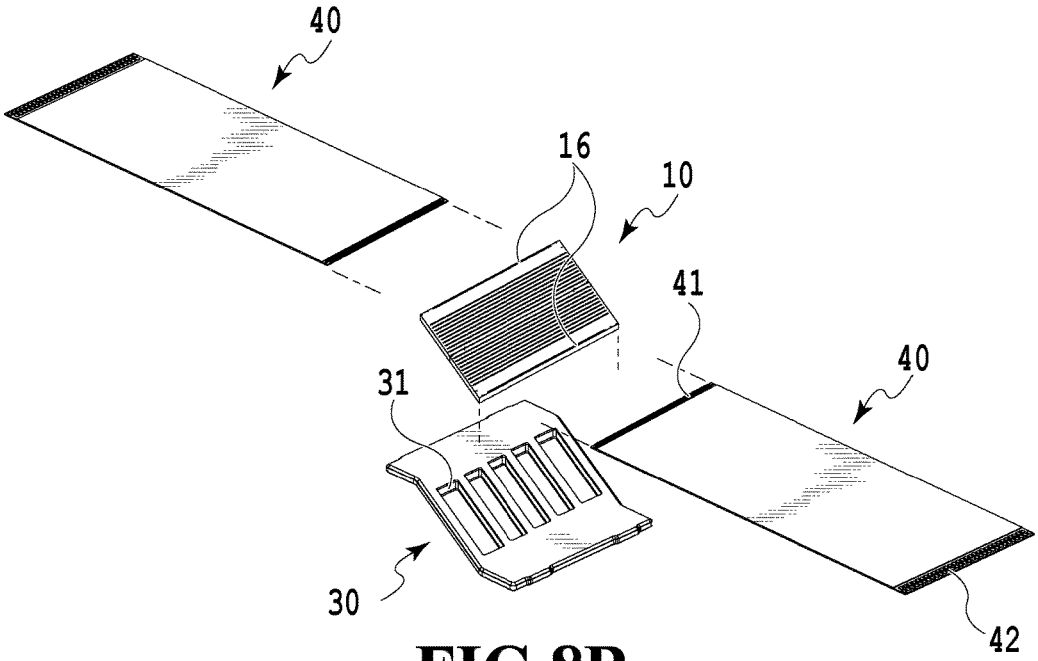
FIG. 8B is an exploded view of the ejection module.

FIG. 8A is a perspective view illustrating one of the ejection modules 200, and FIG. 8B is its exploded view. A plurality of terminals 16 are provided at both edges, respectively, along the direction of a plurality of columns of ejection ports of the print element board 10 (respective long edges of the print element board 10). In accordance therewith, two of the flexible wiring boards (wiring members) 40 electrically connected to the print element board 10 are provided for one of the print element boards 10. This is the result of, with the number of the columns of ejection ports to be provided in the print element board 10 being 20, an increase of the number of wirings, to shorten the maximum distance from terminals 16 to the print element so as to reduce voltage drop and signal delay that may occur in the wiring unit in the print element board 10. In addition, the liquid communication ports 31 of the supporting member 30 are provided on the print element board 10 and opened across all the columns of ejection ports.

(Description of Structure of Print Element Board)

Figure 9:
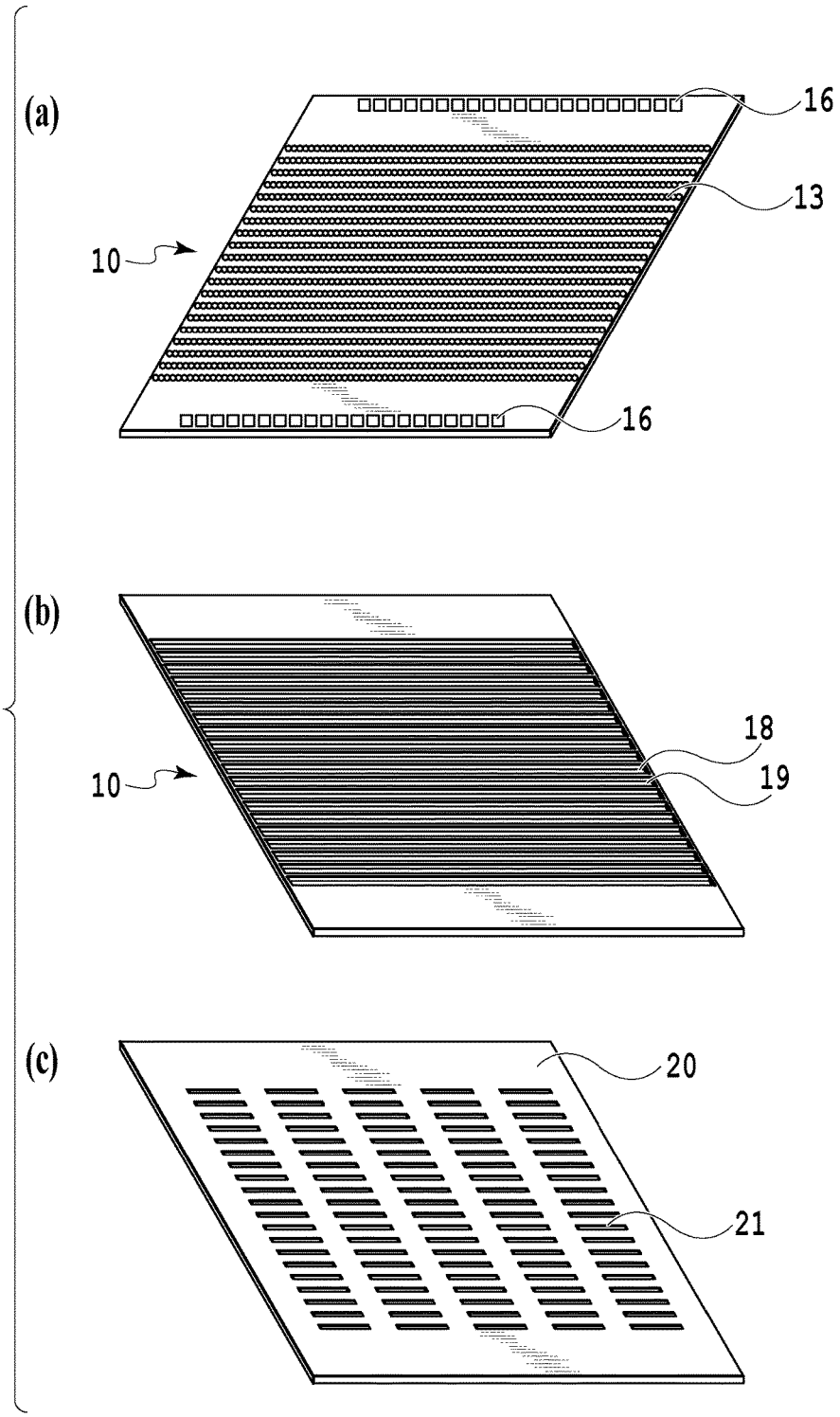
FIG. 9 illustrates a print element board.
Figure 10:
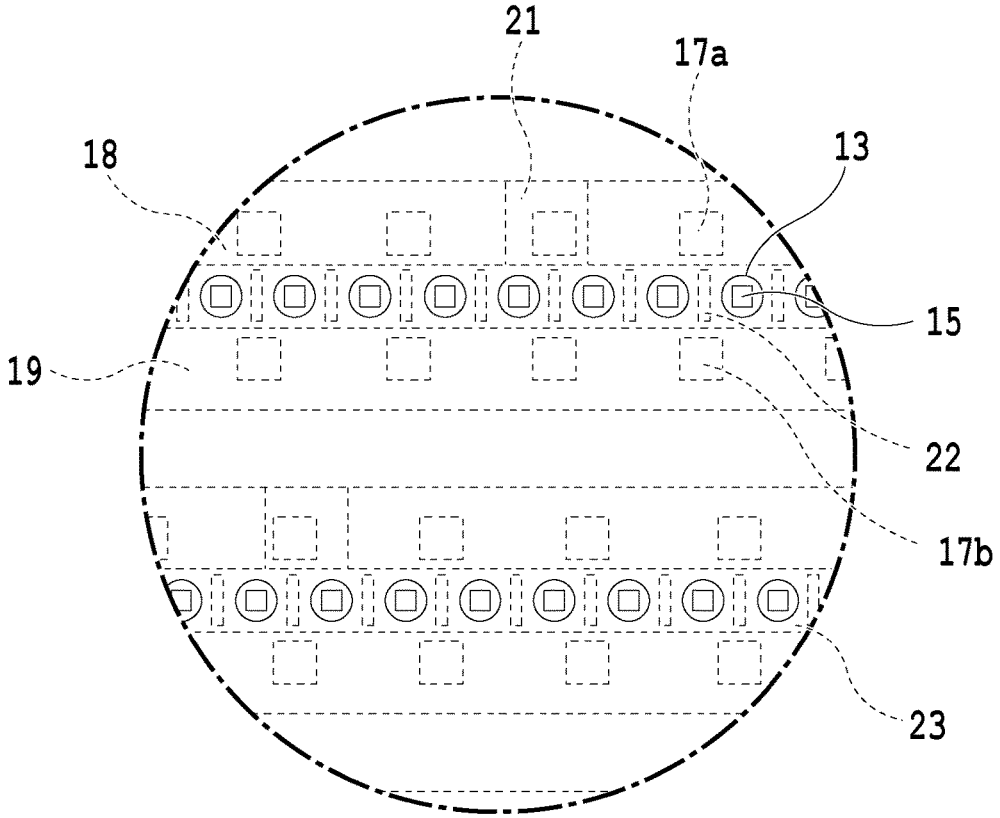
FIG. 10 is a schematic view illustrating the print element board.

FIG. 9 illustrates a print element board. Part (a) of FIG. 9 is a schematic view of a surface of the print element board 10 on which the ejection port 13 is provided, and part (c) of FIG. 9 is a schematic view illustrating the back side of the surface of part (a) of FIG. 9. Part (b) of FIG. 9 is a schematic view illustrating a surface of the print element board 10 with the lid member 20 provided on the back side of the print element board 10 in part (c) of FIG. 9 having been removed. In addition, FIG. 10 is a schematic view illustrating a surface of the print element board 10 with the lid member 20 provided on the back side of the print element board 10 having been removed. The ejection port forming member 12 of the print element board 10 has a plurality of columns of ejection ports formed thereon. Note that, hereinafter, the direction in which the columns of ejection ports extend, with a plurality of ejection ports 13 being provided therein, will be referred to as "ejection port column direction". As illustrated in FIG. 10, print elements 15, i.e., heating elements that cause liquid to foam by heat energy are provided at positions respectively corresponding to the ejection ports 13. In addition, pressure chambers 23 including the print elements 15 inside thereof are partitioned by partition walls 22.

The print elements 15 are electrically connected to the terminals 16 of part (a) of FIG. 9 by an unillustrated electric wiring provided on the print element board 10. In addition, the print elements 15 generate heat to boil the liquid on the basis of a pulse signal input from the control circuit of the liquid ejection apparatus 1000 via the electric wiring board 90 (see FIG. 4) and a flexible wiring board 40 (see FIG. 8B). The foaming force due to the boiling ejects the liquid from the ejection ports 13.

As illustrated in part (b) of FIG. 9, liquid supply paths 18 and liquid collection paths 19 are provided alternately along the ejection port column direction on the back side of the print element board 10. The terminals 16 are provided on both edges along the ejection port column direction of the print element board 10. A pair of the liquid supply path 18 and the liquid collection path 19 is provided for each ejection port column, the liquid supply paths 18 and liquid collection paths 19 being flow paths extending in the ejection port column direction provided on the print element board 10, and each being in communication with the ejection ports 13 via supply ports 17*a* and collection ports 17*b*. The lid member 20 has provided thereon an aperture 21 being in communication with the liquid communication port 31 of the supporting member 30.

(Description of Positional Relation Between Print Element Boards)

Figure 11:
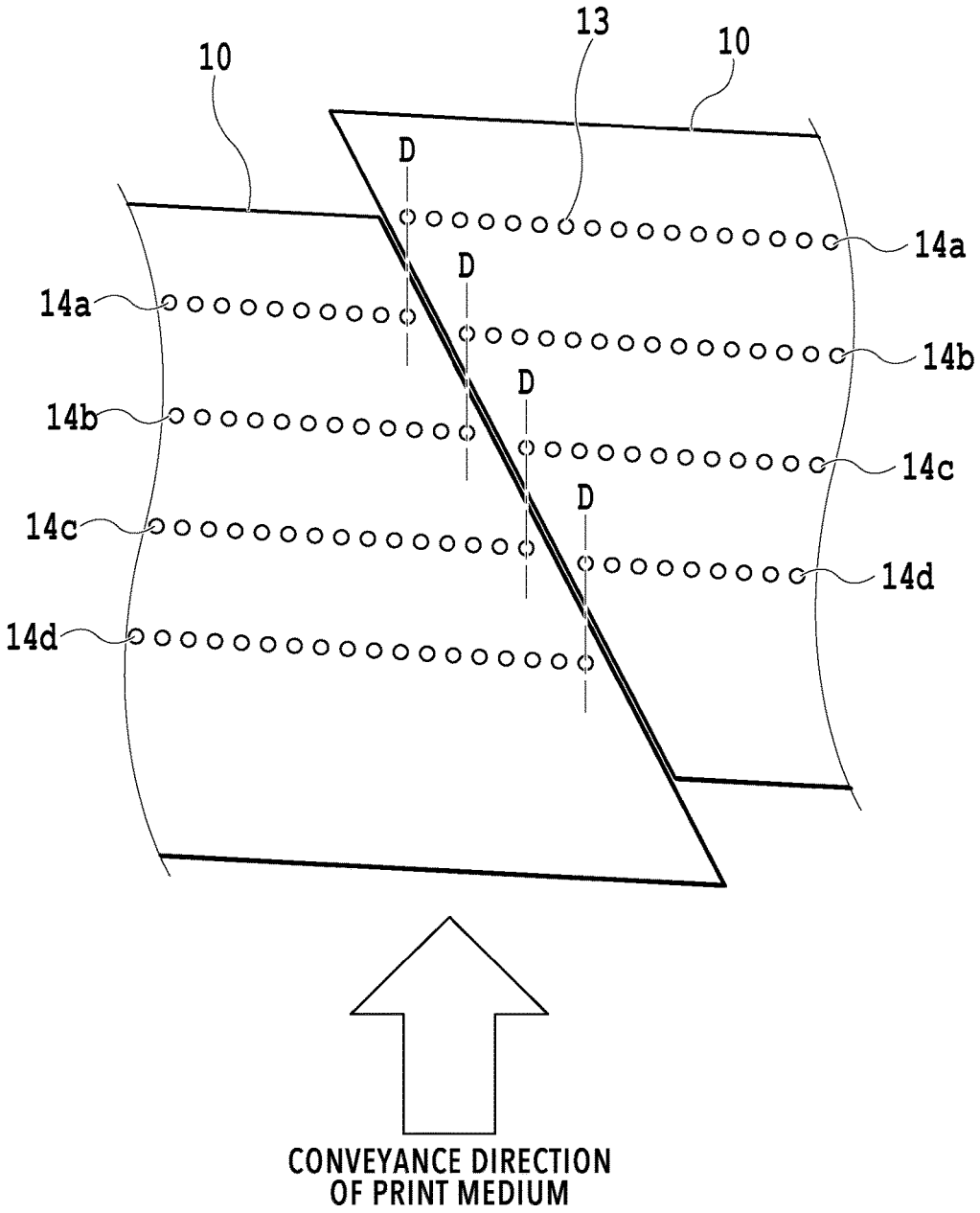
FIG. 11 is a plan view illustrating an adjacent part of the print element board in a partially enlarged manner.

FIG. 11 is a plan view illustrating, in a partially enlarged manner, an adjacent part of the print element board 10 in two ejection modules adjacent to each other. In the present embodiment, a generally parallelogram print element board is used. Respective ejection port columns (14*a* to 14*d*) having ejection ports 13 arranged on each of the print element boards 10 are provided in a manner tilted by a certain angle relative to the longitudinal direction of the liquid ejection head 3. The ejection port column in the adjacent part between the print element boards 10 is arranged such that at least one ejection port overlaps in the conveyance direction of the print medium. In FIG. 11, two ejection ports on line D overlap with each other.

The aforementioned provision allows for making black streaks or white spots in a print image less outstanding by controlling the drive of overlapping ejection ports, even in the case where the position of the print element board 10 has more or less displaced from a predetermined position. Also in the case where a plurality of print element boards 10 are linearly (in-line) arranged, instead of a zigzag arrangement, it is possible to take measures for reducing black streams or white spots in the joint part between the print element boards 10, while suppressing increase of the length of the print medium of the liquid ejection head 3 in the conveyance direction by the configuration illustrated in FIG. 11. In the present embodiment, a plurality of the print element boards 10 are arranged so that adjacent ones of the print element boards 10 partially overlap with each other in the longitudinal direction of the liquid ejection head 3. Note that although the major plane of the print element board 10 is a parallelogram in the present embodiment, the configuration of the present invention is not limited thereto and may also be applied to cases where a print element board taking the shape of, for example, a rectangle, a trapezoid, or any other shape is used.

Figure 12A:
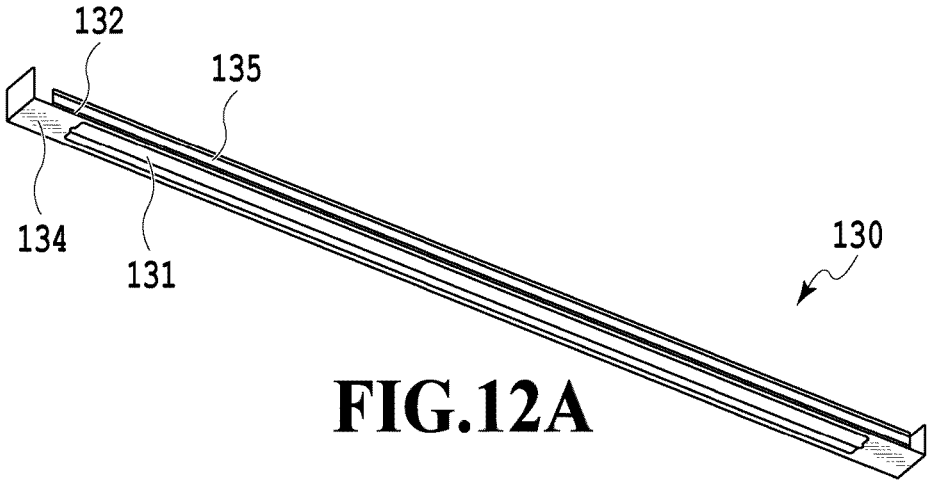
FIG. 12A illustrates a first cover member.
Figure 12B:
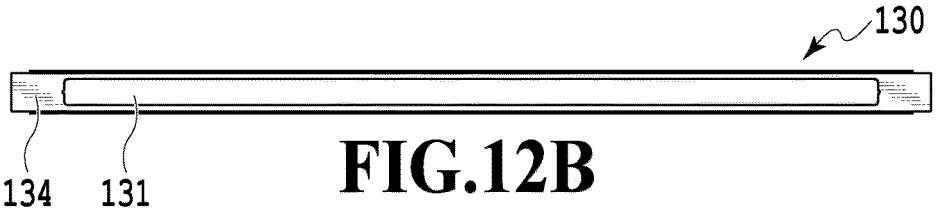
FIG. 12B illustrates the first cover member.
Figure 12C:
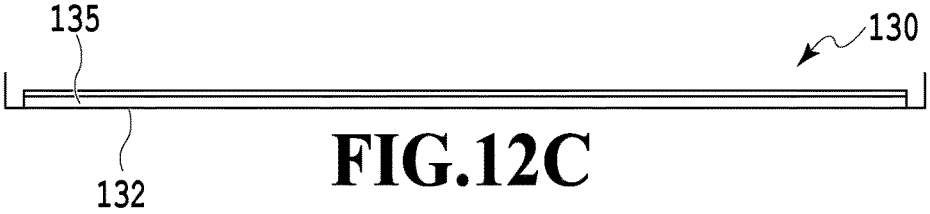
FIG. 12C illustrates the first cover member.
Figure 12D:
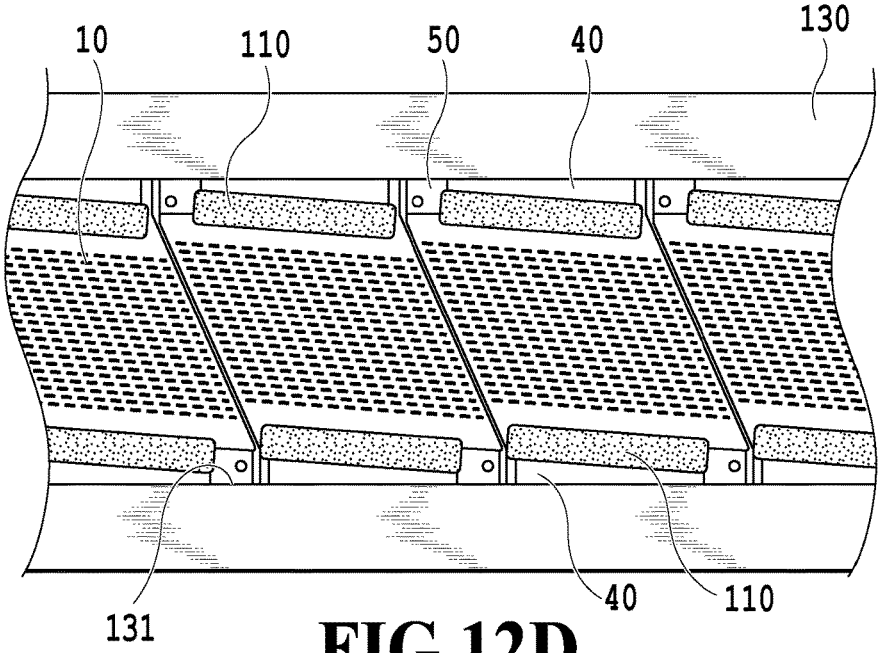
FIG. 12D illustrates the first cover member.

FIGS. 12A to 12C illustrate the first cover member (face cover) 130 of the present embodiment. In addition, FIG. 12D is a top plan view, seen from the side of the ejection port surface, of the liquid ejection unit 300 with the first cover member 130 being attached thereto. As has been described above, attaching the first cover member 130, having the elongated aperture 131 provided thereon, to the liquid ejection unit 300 causes the print element board 10 to be exposed from the aperture 131. In addition, the aperture 131 has no beam or the like provided therein, and therefore the aperture 131 is open all over the entire region where the print element boards 10 are arranged. The role of the first cover member 130 is intended to flatten the surface facing the print medium, reduce the unevenness of air current due to conveyance and ejection, improve the precision of landing of droplets, and also raise the airtightness when abutting a cap 1007 (see FIG. 1) during the non-printing state. Raising the airtightness allows for suppressing thickening of ink due to evaporation of water from the ejection ports.

In the case where the aperture ratio of the first cover member 130, i.e., the ratio of the aperture 131 in the first cover member 130 that exposes the surface facing the print medium of the print element board from the first cover member 130, is large, there is an increased risk that the stiffness of the first cover member 130 may decrease. Particularly, a configuration in which the print element board 10 such as that of the present embodiment is provided in-line has a risk that the aperture ratio may increase, thereby causing deformation in the course of assembly or capping. In other words, the conventional configuration with print element boards arranged in a zigzag manner allows for increasing the un-opened area by providing a face cover in a manner filling the position where no print element board is provided and at the same time raising the stiffness of the face cover. On the other hand, the configuration with the print element boards 10 arranged in-line has a small head width, and there is an increased risk that the width of the first cover member 130 may become smaller, thereby raising the aperture ratio of the first cover member 130, and reducing its stiffness.

Therefore, the present embodiment has a first surface 134 provided on the first cover member 130 at the side of the ejection port surface of the print element board 10, a second surface 135 provided in proximity to the side surface of the first flow path member 50, and a bent part 132 bent between the first surface 134 and the second surface 135. Providing the bent parts 132 on the first cover member 130 raises the stiffness of the first cover member 130. The bent parts 132, extending in the longitudinal direction of the first cover member 130, are provided on both sides of the first cover member 130 respectively in the width direction (lateral direction). In addition, the back side of the surface facing the print medium in the first cover member 130 is adhered to the first flow path member 50 with adhesive.

Figure 14:
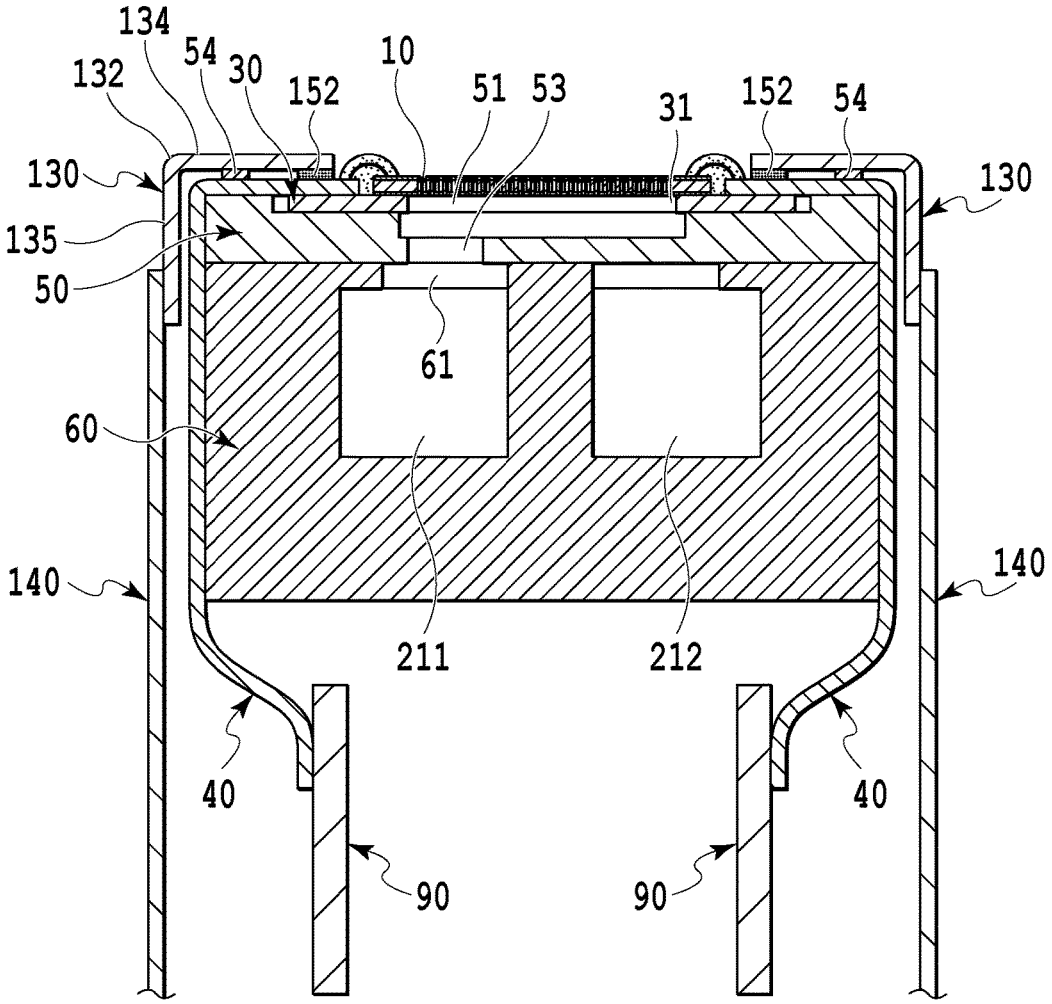
FIG. 14 illustrates a positional relation between the first cover member and the second cover member.

The gap between a marginal part on which the aperture 131 of the first cover member 130 is provided and the first flow path member 50 is sealed by a sealing material 152 (FIG. 14). In other words, as illustrated in FIGS. 12D and 14, a gap has been generated between a part of the first flow path member 50 on which the flexible wiring board 40 is not provided and the first cover member 130 and therefore the sealing material 152 is provided to fill the gap. Note that sealing between the marginal part on which the aperture 131 of the first cover member 130 is provided and the first flow path member 50 may be partial sealing (of a part) of the periphery of the aperture 131. In addition, the sealing may be sealing all over the periphery of the aperture 131, in other words sealing between the marginal part on which the aperture 131 of the first cover member 130 is provided, and the first flow path member 50 and the flexible wiring board 40. Sealing between the marginal part of the aperture 131 and the first flow path member 50 allows for preventing ink from flowing into the void between the first cover member 130 and the first flow path member 50. Accordingly, it is possible to prevent degradation of printing quality due to dropping of ink on the print medium, and decrease of reliability.

The liquid ejection head 3 of the present embodiment has the flexible wiring board 40 connected to the terminals 16 on both ends of the print element board 10 all over the head in the longitudinal direction, as illustrated in FIGS. 4 and 8A. In the case where the first direct cover member 130 is directly adhered on the flexible wiring board 40, it is difficult to ensure the flatness of the first cover member 130. Therefore, as illustrated in FIGS. 5A and 7, a protrusion 54 which is higher than the height of the flexible wiring board 40 is formed on the surface on which the print element board 10 of the first flow path member 50 is mounted, and the first cover member 130 is abutted and adhered to the protrusion 54. In other words, the first flow path member 50 has a joint part adhered to the protrusion 54 with an adhesive material. Such a configuration raises the flatness of the first cover member 130.

The second surface 135 of the first cover member 130 also works to protect the side surface of the head from external factors such as external force, ink or electric noise. The longer the length of the second surface 135, the stronger the side wall is protected, and also the higher the stiffness of the first cover member 130 becomes. However, an excessively long length of the second surface 135 also results in an excessively high stiffness of the first cover member 130, whereby it becomes difficult to make the first cover member conform with the entire region of the first flow path member 50 due to the influence of warpage of members, or the like.

Figure 13A:
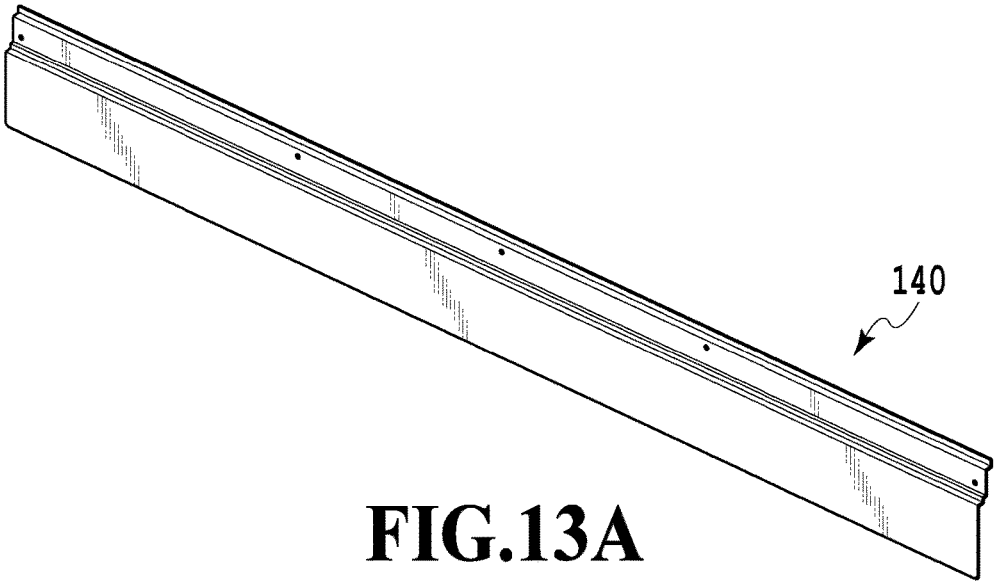
FIG. 13A illustrates a second cover member.
Figure 13B:
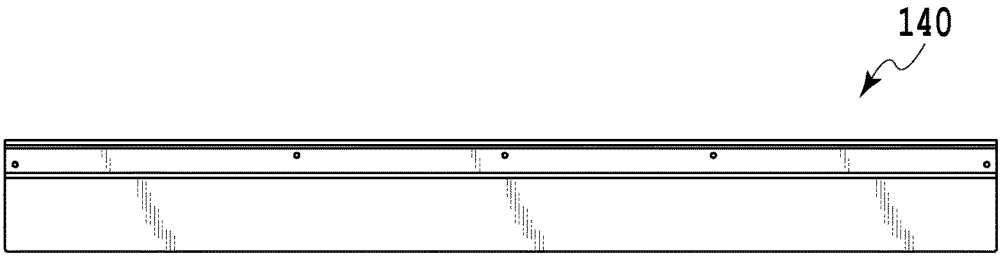
FIG. 13B illustrates the second cover member.
Figure 13C:
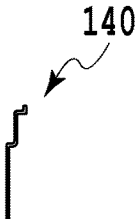
FIG. 13C illustrates the second cover member.

FIGS. 13A to 13C illustrate a second cover member 140. The present invention prevents the stiffness of the first cover member 130 from becoming too high by providing the second cover member 140 on the side wall of the head as another member of the first cover member 130, and also raises the reliability of the side wall of the head. The first cover member 130 and the second cover member 140 are provided so that a part thereof overlaps on the side wall of the head. In addition, there are two of the second cover members 140 provided to protect the side walls at both sides in the lateral direction of the head.

FIG. 14 illustrates a positional relation between the first cover member 130 of the liquid ejection head 3 and the second cover member 140 in the cross-section taken along line VII-VII of FIG. 6. As illustrated, the first cover member 130 and the second cover member 140, being separate members, are configured (with a displacement absorption part) to partially overlap with each other, so as to be capable of absorbing the displacement between each other. In addition, configuring the first cover member 130 and the second cover member 140 as separate members as described above, it is possible to protect the flexible wiring board 40 extending toward the side surface from external force by the second cover member 140, without elongating the length of the second surface 135 of the first cover member 130. In addition, it is possible to make the height of the bent parts 132 lower, whereby the stiffness of the first cover member 130 is prevented from becoming too high.

Furthermore, providing a position at which the cover members partially overlap as described above allows for protecting the side surface of the head from external factors in a seamless manner. It is particularly preferred that the end of the second surface 135 of the first cover member 130 opposite to the bent parts 132 extends in a manner covering the first flow path member 50, and covering a part of the second flow path member 60 to reliably protect the connecting part between the first flow path member 50 and the second flow path member 60. The second cover member 140 is supported by being connected to a member of the liquid ejection unit supporting part 81 as illustrated in FIG. 3A.

In addition, it is possible to protect the bent part of the flexible wiring board 40 from external force by bending the flexible wiring board 40 in a manner conforming with the bent part 132 of the first cover member 130 so as to conform with the side surface of the second flow path member 60. Although the bent part 132 of the first cover member 130 may be provided on all of the four edges, it is preferred to be bent at least on the edge along which the flexible wiring board 40 is bent. In addition, a more preferable configuration may be such that the first cover member 130 and the second cover member 140 are made of conductive material such as stainless steel and formed in a manner covering the electric wiring board 90, which allows for raising the reliability against electric noise. It is more preferable, in terms of removing electric noise, that the first cover member 130 and the second cover member 140 are either at least partly in contact with each other, or connected to each other by a conductive member.

Although the first cover member 130 is provided inside the second cover member 140 in FIG. 14, the first cover member 130 may also be provided outside. In the case where the first cover member 130 is located inside, there is an advantage that the first cover member 130 may be installed before attaching the electric wiring board 90, making the layout at time of the installation easier. In addition, there is also an advantage of the reduced risk that the first cover member 130 may be peeled off due to external force when attaching or detaching the liquid ejection head 3 to and from the liquid ejection apparatus 100. On the other hand, there is an advantage that ink is difficult to flow into the gap between the first and the second cover members in the case of providing the first cover member 130 outside.

(Capping Operation)

The liquid ejection apparatus 1000 can prevent evaporation of ink from the ejection port 13 by causing the first cover member 130 to abut the cap 1007 when not printing. In addition, foam or thickened ink may be absorbed and removed from inside the ejection port 13 by driving a pump connected to the cap 1007 and depressurizing the interior of the cap in the capped state. It is possible to raise the airtightness during the capped state by providing the flat first cover member 130 in a seamless manner all over the periphery of the head.

Second Embodiment

In the following, a second embodiment of the present invention will be described, referring to the drawings. Since the basic configuration of the present embodiment is similar to that of the first embodiment, only characteristic configuration will be described below.

Figure 15:
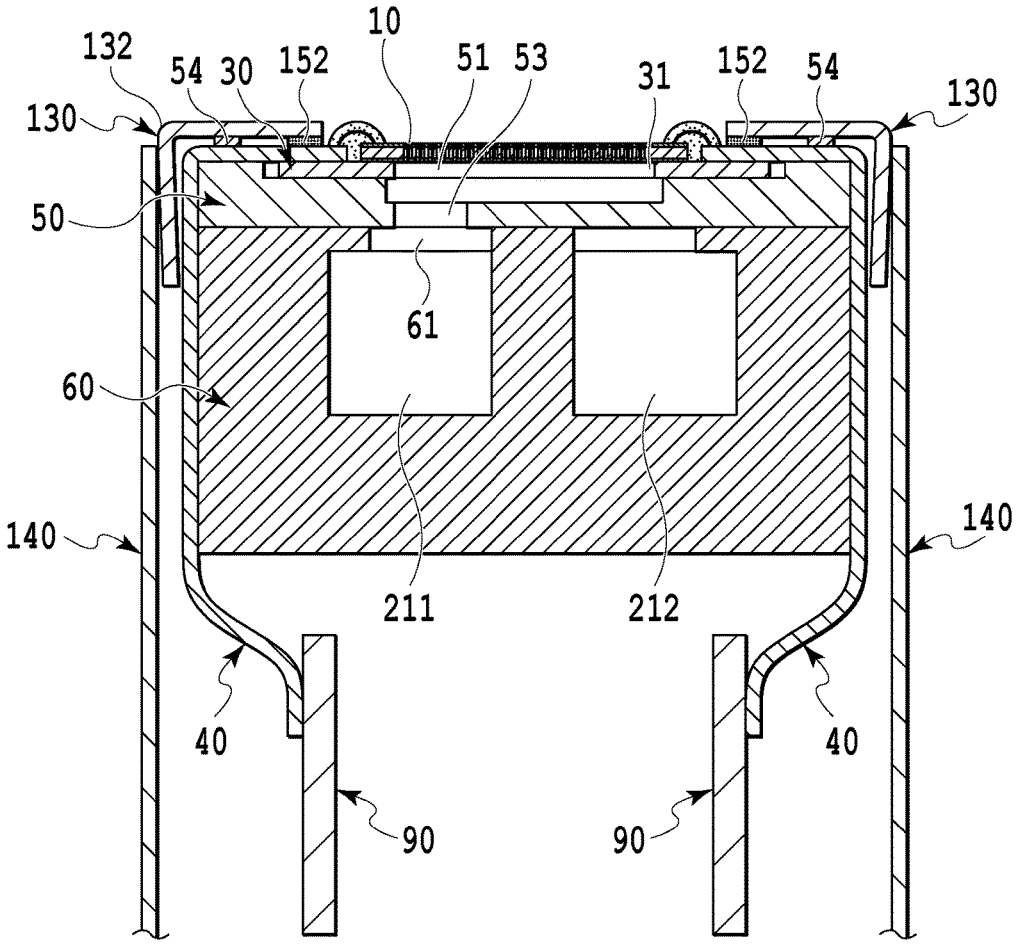
FIG. 15 illustrates a positional relation between the first cover member and the second cover member.

FIG. 15 is a cross-sectional view of a liquid ejection head according to the present embodiment. The first cover member 130 and the second cover member 140 of the liquid ejection head of the present embodiment are different from those of the first embodiment. As illustrated in FIG. 15, the end of the first cover member 130 is bent more inward than the first embodiment, the end being provided at a position closer to the flexible wiring board 40. In other words, the bending angle of the bent part 132 of the first cover member 130 is smaller than the first embodiment. In addition, the second cover member 140 is provided as far as the position of the bent part 132 of the first cover member 130.

The aforementioned configuration allows for keeping a wide space between the second cover member 140 and the side wall of the head and the flexible wiring board 40. Accordingly, it is possible to limit the crawling up of ink to as high as between the first cover member 130 and the second cover member 140, preventing further crawling up. Particularly, it is possible to prevent crawling up on the side wall of the head by preventing the end of the first cover member 130 from contacting the side wall of the head and the flexible wiring board 40.

In addition, preventing the end of the first cover member 130 from contacting the flexible wiring board 40 allows for preventing the flexible wiring board 40 from being damaged by the cover member 130.

As has been described above, the bent part 132 of the first cover member 130 is moved more outward than the first embodiment so as to bend the end inward, and the second cover member 140 is provided as far as a position of the bent part 132 of the first cover member 130. Accordingly, there has been realized a liquid ejection head and a liquid ejection apparatus capable of maintaining a high reliability.

Third Embodiment

In the following, a third embodiment of the present invention will be described, referring to the drawings. Since the basic configuration of the present embodiment is similar to that of the first embodiment, only characteristic configuration will be described below.

Figure 16:
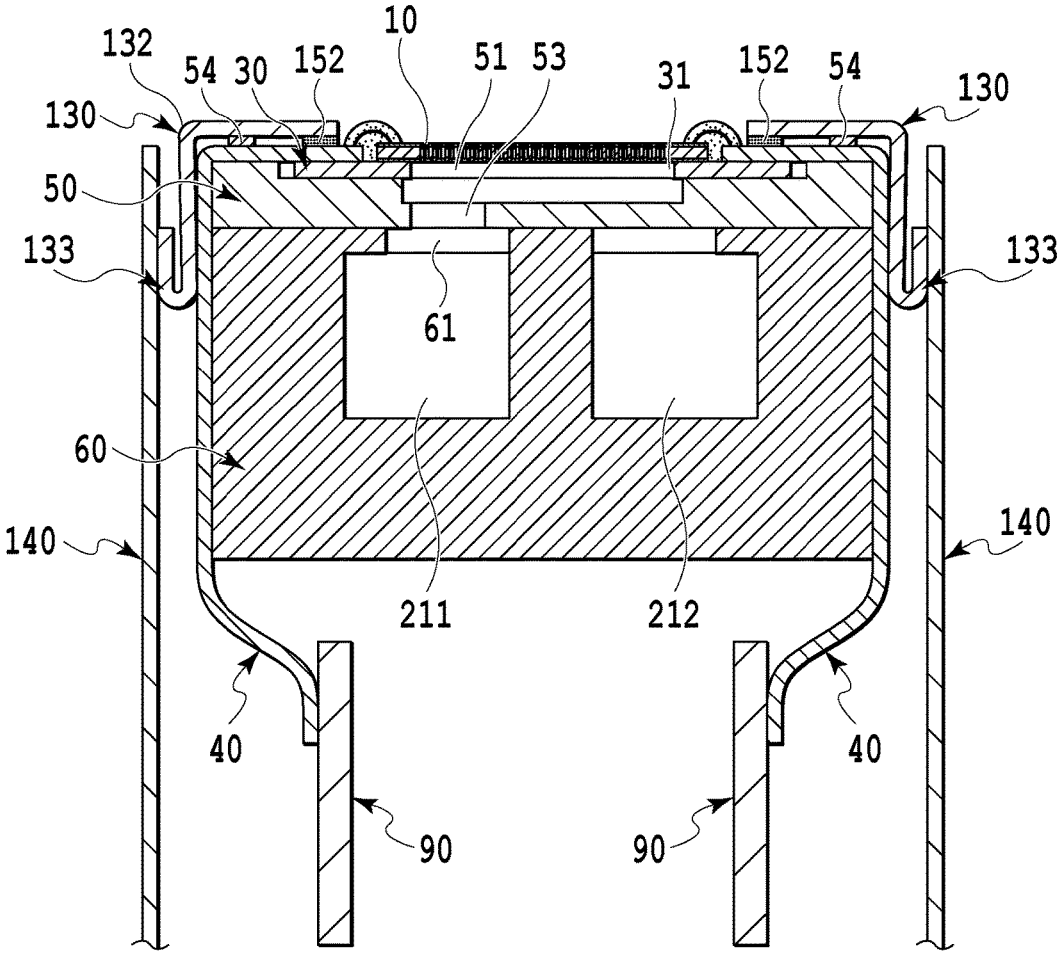
FIG. 16 illustrates a positional relation between the first cover member and the second cover member.

FIG. 16 is a cross-sectional view of a liquid ejection head according to the present embodiment. In the liquid ejection head of the present embodiment, the end of the first cover member 130 is bent outward of the head, thereby forming a bent end 133. Such a configuration widens the gap in the bent part of the first cover member 130 between the first cover member 130 and the second cover member 140, thereby making it difficult for the ink to crawl up. In addition, bending the end of the first cover member 130 allows for preventing damage to the flexible wiring board 40.

As has been described above, the end of the first cover member 130 is bent outward of the head in a manner overlapping with the bent part, thereby forming the bent end 133. Accordingly, there has been realized a liquid ejection head and a liquid ejection apparatus capable of maintaining a high reliability.

Fourth Embodiment

In the following, a fourth embodiment of the present invention will be described, referring to the drawings. Since the basic configuration of the present embodiment is similar to that of the first embodiment, only characteristic configuration will be described below.

Figure 17:
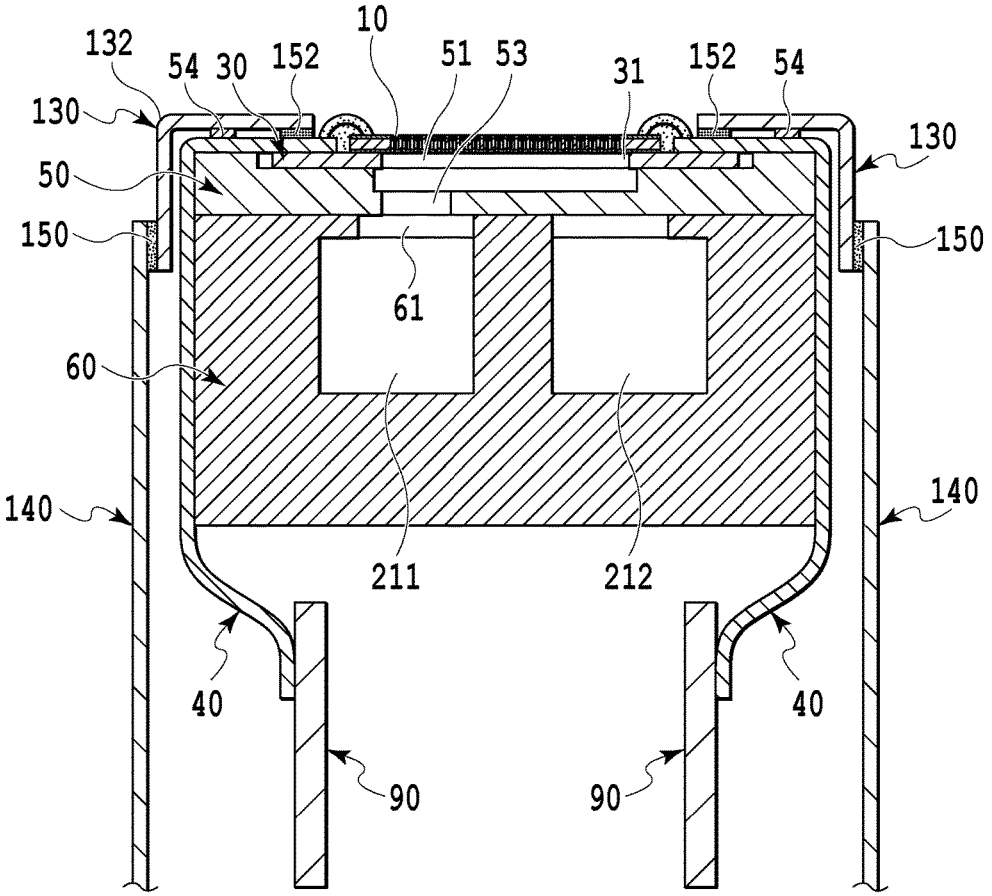
FIG. 17 illustrates a positional relation between the first cover member and the second cover member.

FIG. 17 is a cross-sectional view of a liquid ejection head according to the present embodiment. In the liquid ejection head of the present embodiment, the space between the first cover member 130 and the second cover member 140 is sealed with the second sealing material 150, and the space between the first cover member 130 and the first flow path member 50 is sealed with the first sealing material 152. Accordingly, it is possible to prevent ink from sticking to the side surface of the head or the flexible wiring board 40 more reliably.

In addition, setting the stiffness of the second sealing material 150 to be lower than the stiffness of the first sealing material 152 allows for preventing the stiffness of the second cover member 140 from reinforcing the first cover member 130 so that the stiffness of the first cover member 130 becomes too high. The first sealing material 152 may be used for sealing not only the space between the first cover member 130 and the first flow path member 50 but also the space between the flexible wiring board 40 and the print element board 10. On this occasion, although one type of the first sealing material 152 may be used, a plurality of types may be used in accordance with the position to be sealed.

In addition, using the first sealing material 152 with a low stiffness allows for using the same type of sealing material as the first sealing material 152 and the second sealing material 150.

As has been described above, the space between the first cover member 130 and the first flow path member 50 is sealed with the first sealing material 152, whereas the space between the first cover member 130 and the second cover member 140 is sealed with the second sealing material 150 having a lower stiffness than the first sealing material 152. Accordingly, there has been realized a liquid ejection head and a liquid ejection apparatus capable of maintaining a high reliability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-136574 filed Jul. 12, 2017, which is hereby incorporated by reference herein in its entirety.

What is claimed is:

1. A liquid ejection head comprising:

a liquid ejection unit having a board including an ejection port surface configured to eject liquid, and a flow path member including a supporting surface that supports the board on the back side of the ejection port surface, the flow path member being configured to supply liquid to the board;

a first cover member including a first surface provided at the side of the ejection port surface and having an aperture part exposing the ejection port surface and a joint part joined to the liquid ejection unit, a second surface covering a part of a side surface of the flow path member, and a bent part bent between the first surface and the second surface; and a second cover member at least covering another part of the side surface, wherein a part of the second surface of the first cover member and a part of the second cover member overlap with each other.

2. The liquid ejection head according to claim 1, wherein the flow path member has a first flow path member part including the supporting surface, and a second flow path member part supporting the first flow path member part, and the second surface of the first cover member covers a side surface of the first flow path member part, and an end portion at a side opposite to the bent part of the second surface of the first cover member covers a part of a side surface of the second flow path member part.

3. The liquid ejection head according to claim 2, wherein the second cover member covers a side surface of the second flow path member part.

4. The liquid ejection head according to claim 1, wherein the flow path member includes a protrusion on the supporting surface, and the first surface of the first cover member is adhered to the protrusion.

5. The liquid ejection head according to claim 1, wherein the bent part extends along a longitudinal direction of the liquid ejection head.

6. The liquid ejection head according to claim 1, wherein the first cover member and the second cover member are made of conductive material.

7. The liquid ejection head according to claim 1, further comprising a wiring member electrically connected to the board and provided at a side of the side surface of the flow path member, wherein the first cover member and the second cover member cover the wiring member.

8. The liquid ejection head according to claim 7, wherein the wiring member further includes a third surface provided at a side of the supporting surface, and a bent part bent between the third surface and a fourth surface provided at a side of the side surface of the flow path member, and the first cover member covers the third surface, a part of the fourth surface, and the bent part of the wiring member.

9. The liquid ejection head according to claim 8, wherein a space between a marginal part forming the aperture of the first surface of the first cover member, and the supporting surface of the flow path member and the third surface of the wiring member is sealed with a sealing material.

10. The liquid ejection head according to claim 7, wherein a gap is provided between the wiring member and an end portion of either the first cover member or the second cover member located at a side of the wiring member, in a part where the part of the second surface of the first cover member and the part of the second cover member overlap with each other.

11. The liquid ejection head according to claim 1, wherein the second cover member covers at least a part of the second surface of the first cover member.

12. The liquid ejection head according to claim 11, wherein an end portion of the second cover member covering the second surface of the first cover member is in contact with the first cover member, but an end portion at a side opposite to the bent part of the second surface of the first cover member is not in contact with the second cover member.

13. The liquid ejection head according to claim 11, wherein an end portion at a side opposite to the bent part of the first cover member is bent in an overlapping manner, in a part where the part of the second surface of the first cover member and the part of the second cover member overlap with each other.

14. The liquid ejection head according to claim 1, wherein a space between the first cover member and the second cover member is sealed with a sealing material, in a part where the part of the second surface of the first cover member and the part of the second cover member overlap with each other.

15. The liquid ejection head according to claim 14, wherein a space between a marginal part forming the aperture of the first surface of the first cover member and the supporting surfaces of the flow path member is sealed with a sealing material having a higher stiffness than the sealing material sealing the space between the first cover member and the second cover member.

16. The liquid ejection head according to claim 1, wherein a plurality of the boards are arranged along a longitudinal direction of the liquid ejection head so that the adjacent boards have parts partially overlapping with each other along the longitudinal direction.

17. A liquid ejection apparatus including the liquid ejection head according to claim 1 and a conveyance unit configured to convey a print medium that receives liquid ejected from the liquid ejection head.

* * * * *